US009174137B2

(12) United States Patent
Palmer et al.

(10) Patent No.: US 9,174,137 B2
(45) Date of Patent: Nov. 3, 2015

(54) PET HEAD KITS AND METHODS OF MAKING AND USING THE SAME

(71) Applicants: Pandora E. Palmer, Stockbridge, GA (US); Patricia J. Moore, McDonough, GA (US)

(72) Inventors: Pandora E. Palmer, Stockbridge, GA (US); Patricia J. Moore, McDonough, GA (US)

( * ) Notice: Subject to any disclaimer, the term of this patent is extended or adjusted under 35 U.S.C. 154(b) by 0 days.

(21) Appl. No.: 14/444,002

(22) Filed: Jul. 28, 2014

(65) Prior Publication Data

US 2015/0087199 A1 Mar. 26, 2015

Related U.S. Application Data

(60) Provisional application No. 61/882,807, filed on Sep. 26, 2013.

(51) Int. Cl.

| | |
|---|---|
| ***A63H 3/16*** | (2006.01) |
| ***A63H 3/02*** | (2006.01) |
| ***A63H 9/00*** | (2006.01) |
| ***A63H 3/50*** | (2006.01) |

(52) U.S. Cl.

CPC .. *A63H 3/02* (2013.01); *A63H 3/16* (2013.01); *A63H 3/50* (2013.01); *A63H 9/00* (2013.01)

(58) Field of Classification Search

USPC ..... 446/71, 72, 74, 97, 99, 100, 101, 118, 446/268, 321, 369, 372, 391

See application file for complete search history.

(56) References Cited

U.S. PATENT DOCUMENTS

| | | | | | |
|---|---|---|---|---|---|
| 2,175,319 | A | * | 10/1939 | Rubenstein | 150/120 |
| 2,748,517 | A | * | 6/1956 | Berkis | 40/586 |
| 3,526,103 | A | * | 9/1970 | Lieber | 63/23 |
| 3,867,971 | A | * | 2/1975 | Hazan | 150/104 |
| 4,581,904 | A | * | 4/1986 | Lehmann et al. | 63/23 |
| 5,035,072 | A | * | 7/1991 | Rich | 40/539 |
| 5,054,611 | A | * | 10/1991 | Russomanno et al. | 206/45.28 |
| 5,072,998 | A | * | 12/1991 | Oh | 312/204 |
| 5,378,184 | A | * | 1/1995 | Bro et al. | 446/99 |
| 5,673,501 | A | * | 10/1997 | Mathews | 36/136 |
| 5,803,266 | A | * | 9/1998 | Blackwelder | 206/575 |
| 5,813,584 | A | | 9/1998 | Mauser | |
| 5,897,420 | A | * | 4/1999 | Lawrence et al. | 446/321 |
| 5,906,846 | A | * | 5/1999 | Coleman et al. | 426/104 |
| 5,979,085 | A | * | 11/1999 | Ross et al. | 36/136 |
| 6,012,203 | A | * | 1/2000 | Baron Pearson | 24/114.9 |
| 6,047,709 | A | * | 4/2000 | Tu | 132/275 |
| 6,289,903 | B1 | * | 9/2001 | Haufler | 132/275 |
| 6,296,540 | B1 | * | 10/2001 | LaPlaca et al. | 446/75 |
| 6,626,184 | B1 | * | 9/2003 | Cheng | 132/275 |
| 6,631,723 | B1 | * | 10/2003 | Mullin | 132/73 |
| 6,887,120 | B2 | * | 5/2005 | Shamitoff | 446/99 |
| 6,926,152 | B2 | * | 8/2005 | Leung | 206/769 |
| 7,200,959 | B2 | * | 4/2007 | Spann | 36/136 |
| 7,237,347 | B2 | * | 7/2007 | Tobias | 36/112 |
| 7,389,567 | B2 | * | 6/2008 | Rogers et al. | 24/113 R |
| 7,698,836 | B2 | * | 4/2010 | Schmelzer et al. | 36/136 |
| 7,730,564 | B2 | * | 6/2010 | Moore | 5/639 |
| 8,069,538 | B2 | * | 12/2011 | Wilcox | 24/109 |
| D654,052 | S | * | 2/2012 | Lee et al. | D14/205 |
| 8,540,544 | B1 | * | 9/2013 | Logue | 446/26 |
| 8,763,163 | B1 | * | 7/2014 | Johns | 2/200.1 |
| 2005/0016210 | A1 | | 1/2005 | Weiss et al. | |
| 2005/0103051 | A1 | | 5/2005 | Jacquin | |
| 2006/0007668 | A1 | * | 1/2006 | Chien | 362/103 |
| 2010/0221975 | A1 | | 9/2010 | Kimbrough | |
| 2012/0073032 | A1 | * | 3/2012 | Tigan et al. | 2/209.13 |
| 2012/0264349 | A1 | | 10/2012 | Ciampitti et al. | |

* cited by examiner

*Primary Examiner* — Kurt Fernstrom
(74) *Attorney, Agent, or Firm* — Withers & Keys, LLC

(57) ABSTRACT

Pet head kits and methods of making and using the same are disclosed.

20 Claims, 12 Drawing Sheets

PET HEAD KITS AND METHODS OF MAKING AND USING THE SAME

CROSS-REFERENCE TO RELATED APPLICATIONS

This patent application claims the benefit of priority to U.S. provisional patent application Ser. No. 61/882,807 entitled "PET HEAD KITS AND METHODS OF MAKING AND USING THE SAME" filed on Sep. 26, 2013, the subject matter of which is incorporated herein in its entirety.

FIELD OF THE INVENTION

The present invention relates to pet head kits and methods of making and using the same.

BACKGROUND OF THE INVENTION

Efforts continue to provide aesthetically pleasing toys/accessories for children.

SUMMARY OF THE INVENTION

The present invention is directed to pet head kits and methods of making and using the pet head kits. The pet head kits of the present invention provide an aesthetically pleasing way for a child to collect, share and display one or more stuffed animal heads on various accessory items such as a hair accessory, a piece of clothing, a purse, etc.

In one exemplary embodiment, the pet head kit of the present invention comprises (I) one or more individual stuffed animal heads, wherein each stuffed animal head (i) has an upper head portion and a lower neck portion, and (ii) comprises: one or more pieces of fabric; a batting material encompassed by the one or more pieces of fabric; a first bonding material capable of bonding two or more portions of the one or more pieces of fabric to one another so as to enclose the batting material within the one or more pieces of fabric; one or more objects attached to an outer surface of the one or more pieces of fabric within the upper head portion; and a head male or female connector attached to the outer surface of the one or more pieces of fabric within the lower neck portion; and (II) one or more accessory items, wherein each accessory item (i) is selected from the group consisting of a headband, a hair bow, a barrette, an elastic ponytail holder, and any combination thereof, and (ii) comprises: a substrate having an upper substrate surface and a lower substrate surface opposite the upper substrate surface; and a substrate female or male connector attached to the upper substrate surface, the substrate female or male connector enabling attachment of one of the one or more individual stuffed animal heads to the one or more accessory items via the head male or female connector.

The present invention is further directed to methods of making pet head kits. In one exemplary embodiment, the method of making a pet head kit of the present invention comprises (I) forming at least one individual stuffed animal head, wherein each stuffed animal head has an upper head portion and a lower neck portion, said step of forming at least one individual stuffed animal head comprising: attaching two or more portions of one or more pieces of fabric to one another so as to enclose a batting material within the one or more pieces of fabric; attaching one or more objects to an outer surface of the one or more pieces of fabric within the upper head portion; and attaching a head male or female connector to the outer surface of the one or more pieces of fabric within the lower neck portion; and (II) forming one or more accessory items, wherein each accessory item is selected from the group consisting of a headband, a hair bow, a barrette, an elastic ponytail holder, and any combination thereof, wherein said step of forming the one or more accessory items comprises: providing a substrate having an upper substrate surface and a lower substrate surface opposite the upper substrate surface; and attaching a substrate female or male connector to the upper substrate surface of the substrate, the substrate female or male connector enabling attachment of one of the one or more individual stuffed animal heads to the one or more accessory items via the head male or female connector.

The present invention is even further directed to methods of using pet head kits. In one exemplary embodiment, the method of using a pet head kit of the present invention comprises providing one or more of the herein-described individual stuffed animal heads; and providing one or more of the herein-described accessory items. The method of using a pet head kit may further comprise additional steps including, but not limited to, selecting a first accessory item from the one or more accessory items; attaching a first individual stuffed animal head of the one or more individual stuffed animal heads to the first accessory item; detaching the first individual stuffed animal head from the first accessory item; attaching a second individual stuffed animal head of the one or more individual stuffed animal heads to the first accessory item; selecting a second accessory item from the one or more accessory items; attaching the first individual stuffed animal head of the one or more individual stuffed animal heads to the second accessory item; detaching at least one of the one or more individual stuffed animal heads from a material strip having an strip outer surface and multiple strip female or male connectors attached to the strip outer surface, the multiple strip female or male connectors enabling attachment of two or more of the individual stuffed animal heads to the material strip via two or more of the head male or female connectors; and storing the one or more individual stuffed animal heads and the one or more accessory items within a carrying case.

These and other features and advantages of the present invention will become apparent after a review of the following detailed description of the disclosed embodiments and the appended claims.

BRIEF DESCRIPTION OF THE FIGURES

The present invention is further described with reference to the appended figures showing exemplary embodiments of the present invention, wherein.

DETAILED DESCRIPTION OF THE INVENTION

The present invention is directed to pet head kits and methods of making and using the same. In particular, the present invention is directed to pet head kits as shown in the figures, as described in the various embodiments shown and described herein, and as recited in the claims below.

Figure 1:
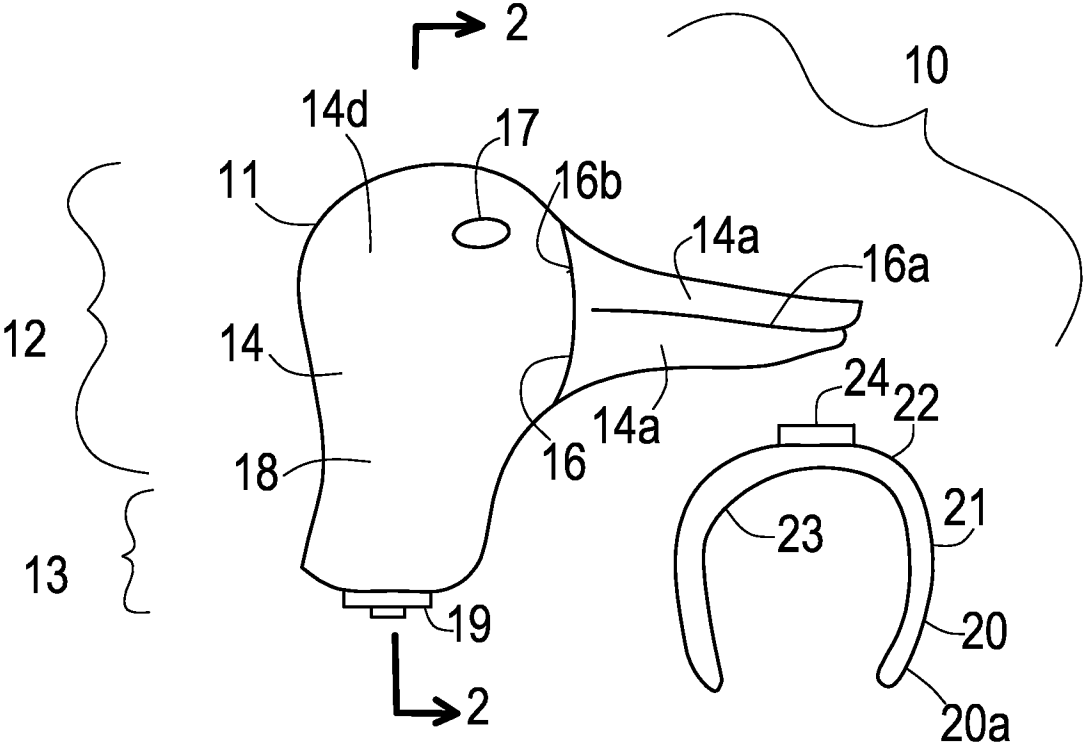
FIG. 1 provides a side view of an exemplary pet head kit of the present invention.
Figure 2:
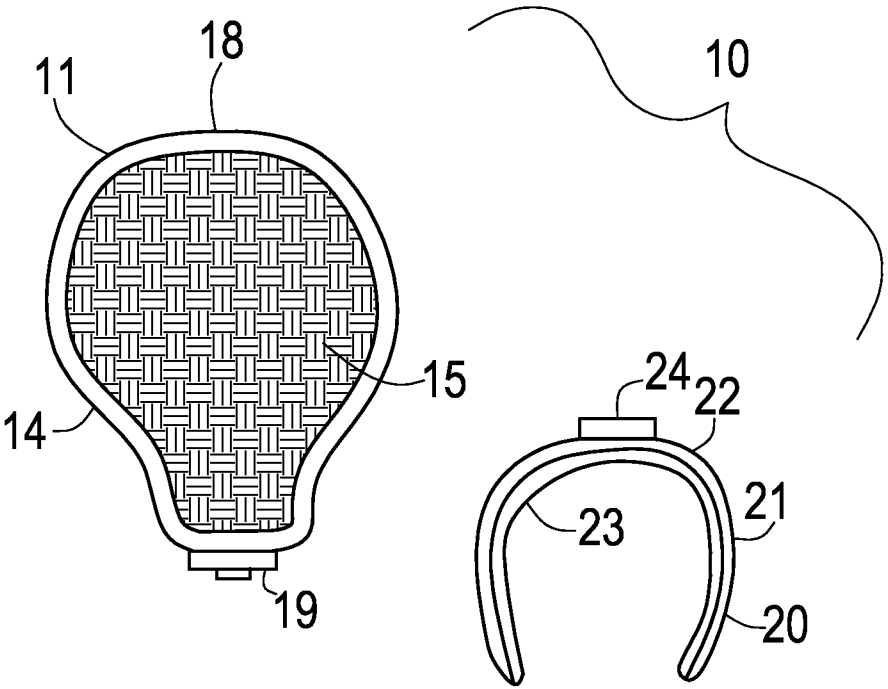
FIG. 2 provides a cross-sectional view of the exemplary pet head kit shown in FIG. 1 along line 2-2 shown in FIG. 1.
Figure 3:
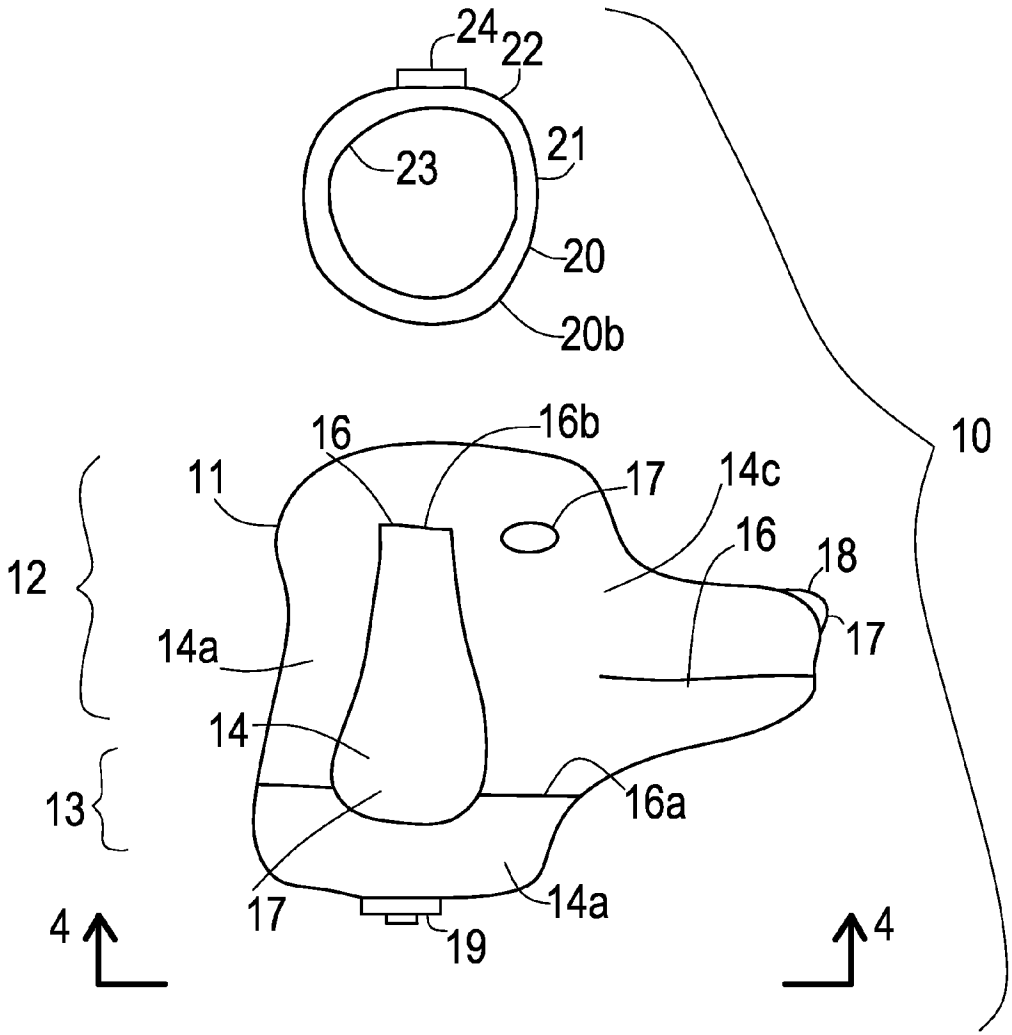
FIG. 3 provides a side view of another exemplary pet head kit of the present invention.
Figure 4:
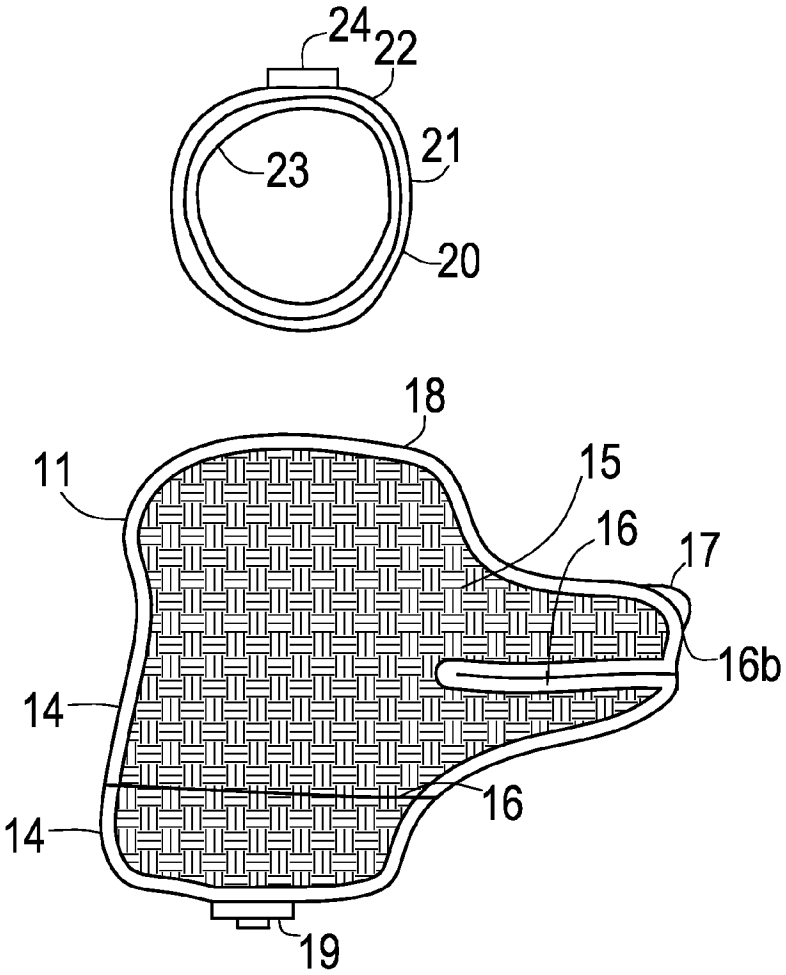
FIG. 4 provides a cross-sectional view of the exemplary pet head kit shown in FIG. 3 along line 4-4 shown in FIG. 3.
Figure 5:
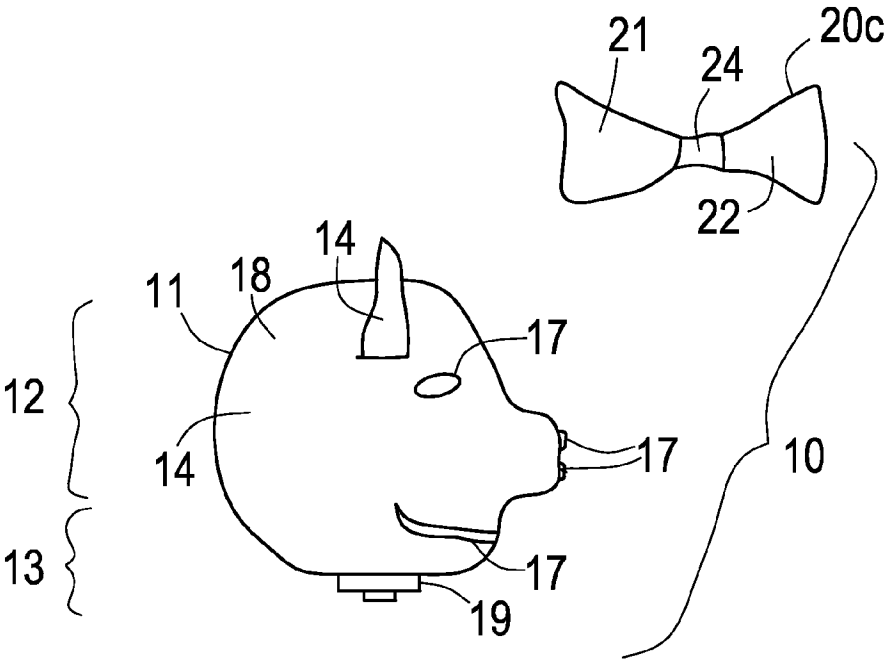
FIG. 5 provides a side view of another exemplary stuffed animal head suitable for use in the pet head kits of the present invention.
Figure 6:
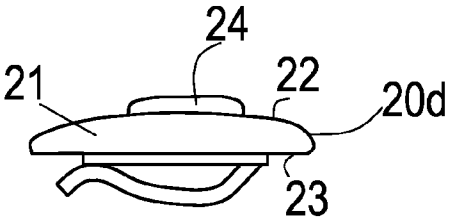
FIG. 6 provides a side view of another exemplary accessory item suitable for use in the pet head kits of the present invention.
Figure 7:
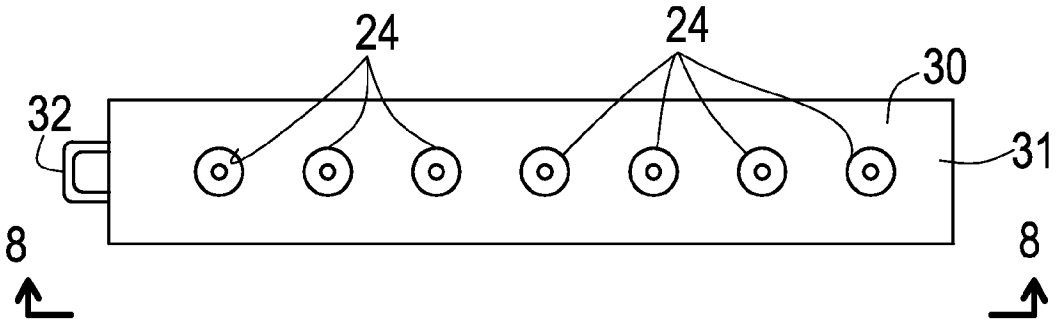
FIG. 7 provides a side view of an exemplary material strip suitable for use in the pet head kits of the present invention.
Figure 8:
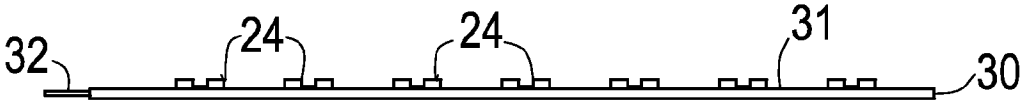
FIG. 8 provides a cross-sectional view of the exemplary material strip shown in FIG. 7 along line 8-8 shown in FIG. 7.
Figure 9:
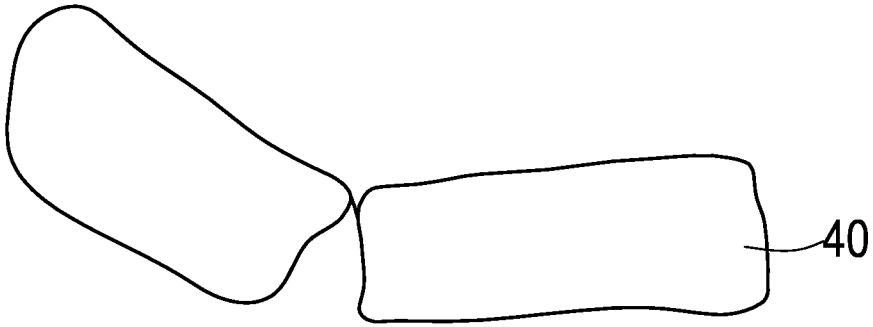
FIG. 9 provides a side view of an exemplary carrying case suitable for use in the pet head kits of the present invention.
Figure 10:
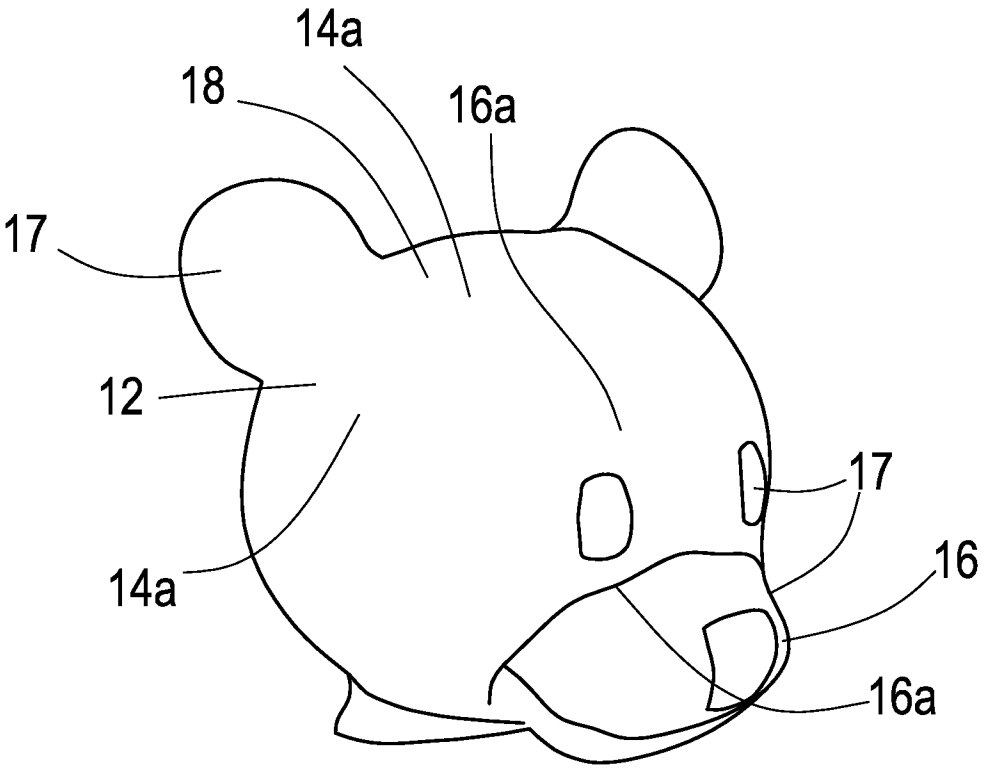
FIG. 10 provides a photographic view of an exemplary pet head of the present invention.
Figure 11:
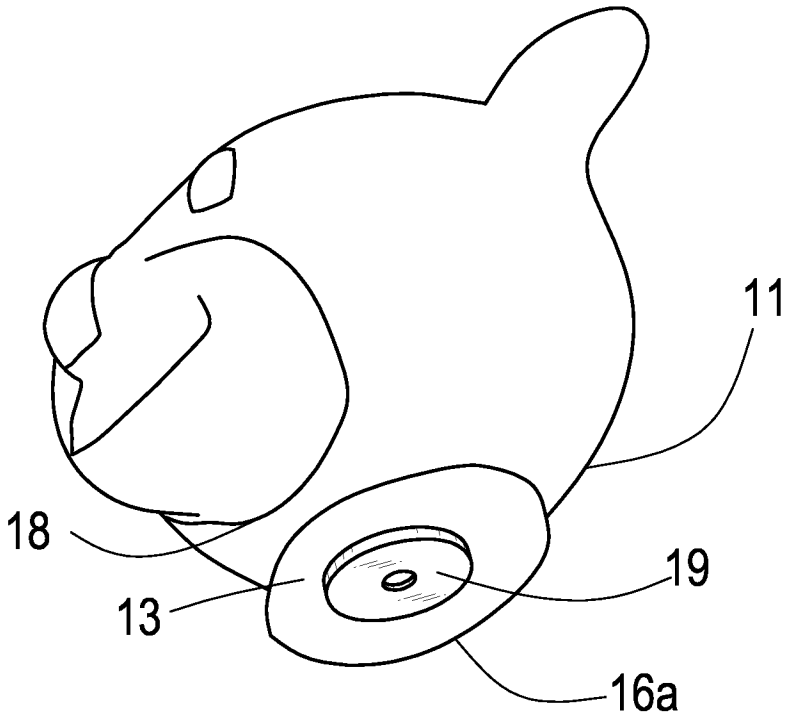
FIG. 11 provides a photographic view of a neck region of the exemplary pet head shown in FIG. 10.
Figure 12:
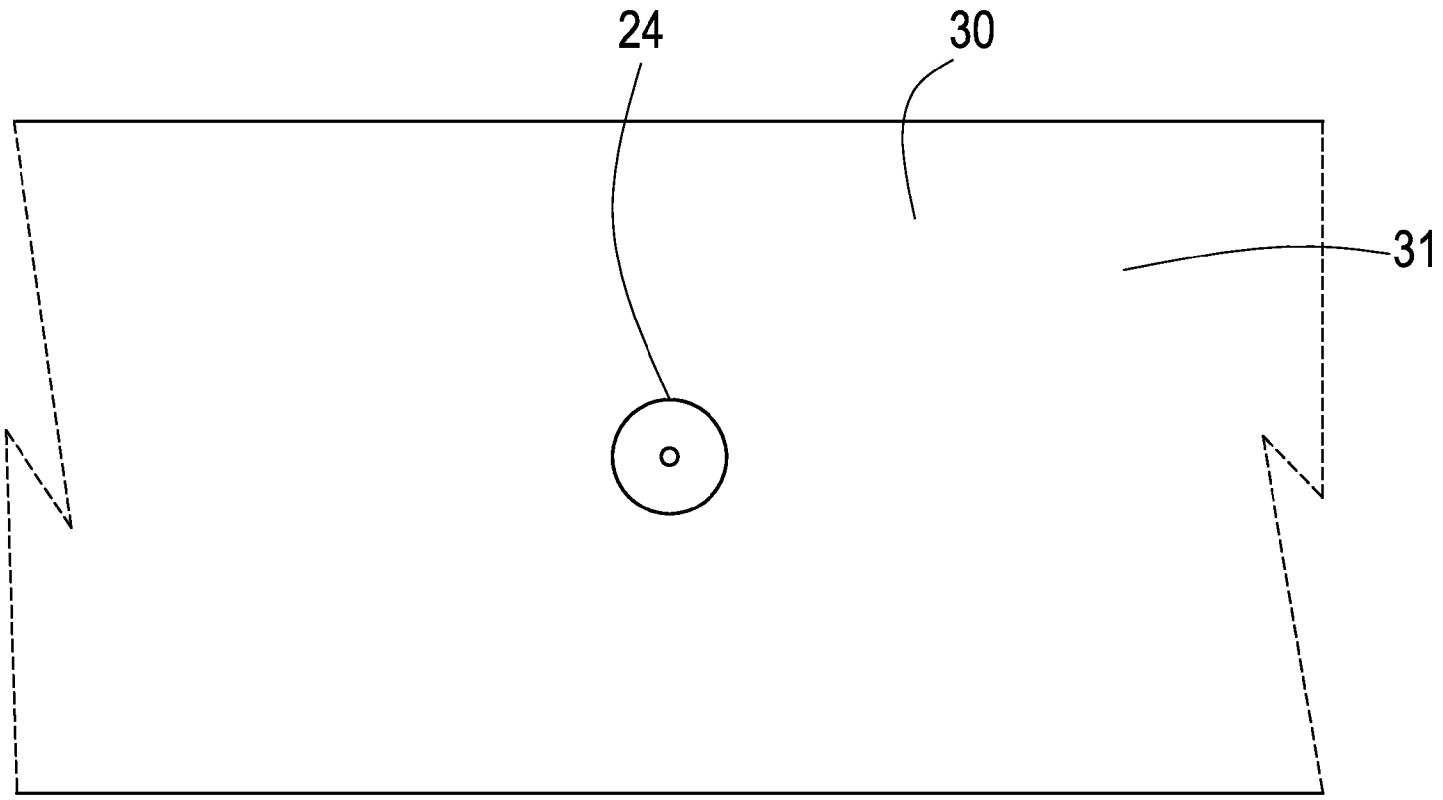
FIG. 12 provides a photographic view of an exemplary material strip of the present invention.
Figure 13:
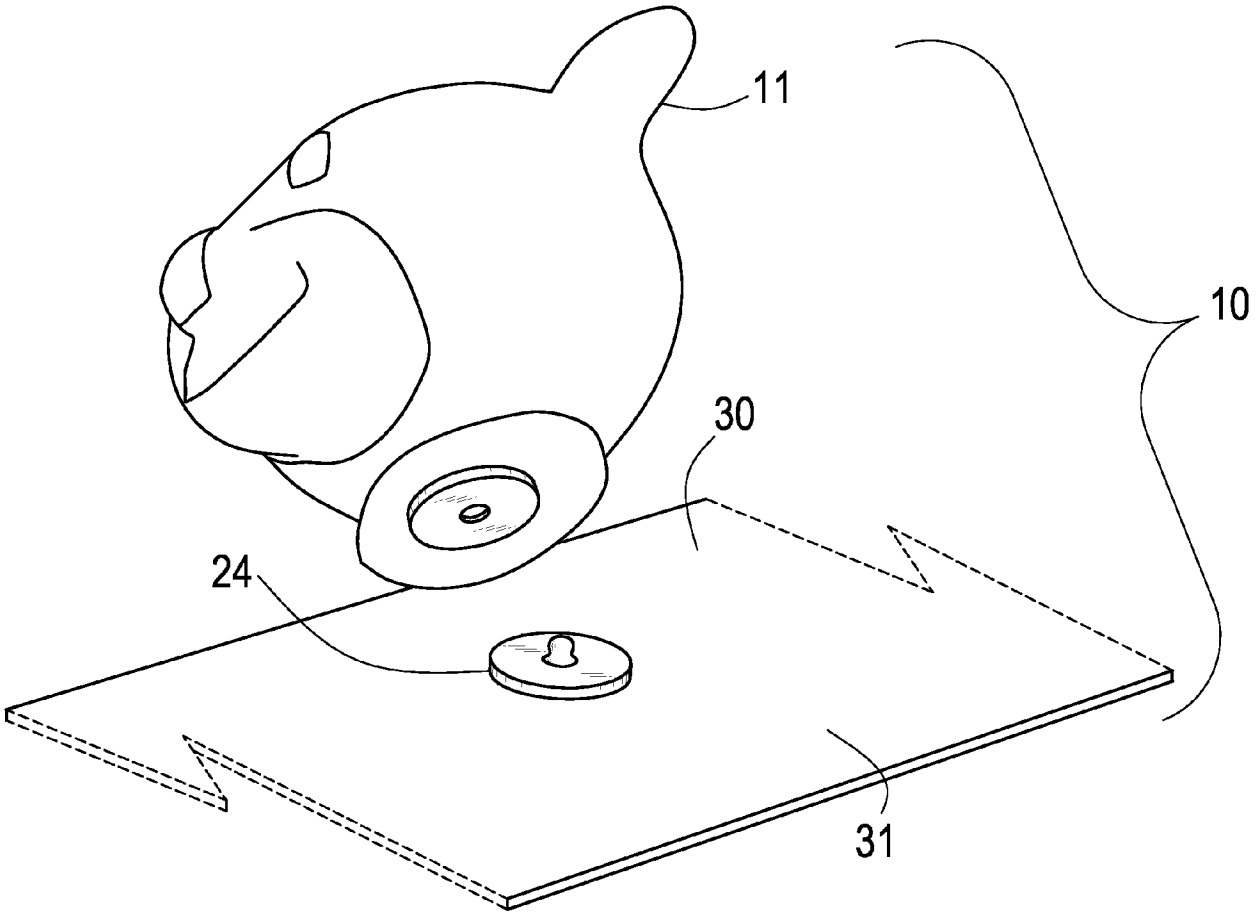
FIG. 13 provides a photographic view of the exemplary pet head shown in FIG. 10 attached to the exemplary material strip shown in FIG. 12.
Figure 14:
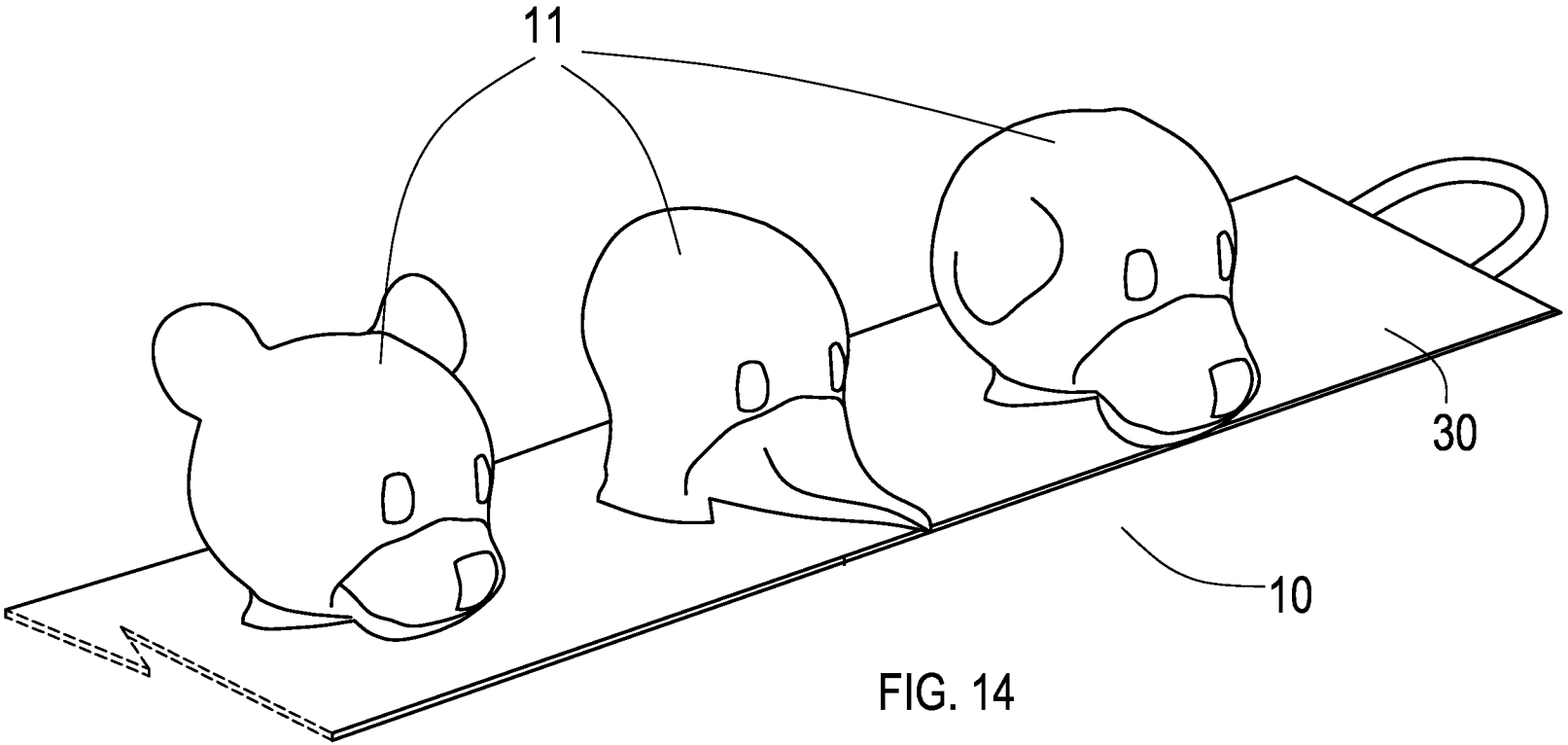
FIG. 14 provides a photographic view of an exemplary pet head kit of the present invention comprising multiple pet heads attached to a material strip suspended from a light switch.

The pet head kits of the present invention may comprise an assortment of plush animal heads that snap on to various substrates including, but not limited to, hair accessories such as headbands, ponytail holders, barrettes and bows; a display material (e.g., a material strip such as material strip 30 shown in Figs. 7-8) for displaying one or more, typically, two or more, and up to as many as 50 animal heads; an accessory item such as a belt, a shoe or a pair of shoes, a hat, a book bag, a purse or backpack; and any combination thereof.

The pet head kits of the present invention may comprise specific combinations of animal heads, such as a farm animal collection, a zoo animal collection, a holiday animal collection, and a sports team's animal collection, etc.

Materials for forming each pet head may include, but are not limited to: various fur type materials made out of cotton and polyester; cotton, nylon or polyester batting; cotton, nylon and plastic thread; plastic beading (e.g., for eyes and noses); metal snaps (or any other type of male or female connector), various ribbons, or any combination thereof.

Any of the herein-described pet head kits may be formed using conventional techniques as described in the embodiments provided below.

Other Embodiments:

Pet Head Kits:

1. A pet head kit 10 comprising: (I) one or more individual stuffed animal heads 11, wherein each stuffed animal head 11 (i) has an upper head portion 12 and a lower neck portion 13, and (ii) comprises: one or more pieces of fabric 14; a batting material 15 encompassed by said one or more pieces of fabric 14; a first bonding material 16 (also referred to as 16*a*) capable of bonding two or more portions 14*a* of said one or more pieces of fabric 14 to one another so as to enclose said batting material 15 within said one or more pieces of fabric 14; one or more objects 17 attached to an outer surface 18 of said one or more pieces of fabric 14 within said upper head portion 12; and a head male or female connector 19 attached to said outer surface 18 of said one or more pieces of fabric 14 within said lower neck portion 13; and (II) one or more accessory items 20, wherein each accessory item 20 (i) is selected from the group consisting of a hair accessory comprising a headband 20*a*, a hair bow 20*c*, a barrette 20*d*, and an elastic ponytail holder 20*b*, a fashion accessory comprising a belt, a pair of shoes, a hat, a book bag, a purse or backpack, and any combination thereof, and (ii) comprises: a substrate 21 having an upper substrate surface 22 and a lower substrate surface 23 opposite said upper substrate surface 22; and a substrate female or male connector 24 attached to said upper substrate surface 22, said substrate female or male connector 24 enabling attachment of one of said one or more individual stuffed animal heads 11 to said one or more accessory items 20 via said head male or female connector 19.
2. The pet head kit 10 of embodiment 1, wherein said one or more pieces of fabric 14 comprise cotton fabric, polyester fabric, polyester/cotton blend fabric, or any combination thereof.
3. The pet head kit 10 of embodiment 1 or 2, wherein at least one portion 14*c* of said one or more pieces of fabric 14 comprises a pile fabric.
4. The pet head kit 10 of any one of embodiments 1 to 3, wherein at least one portion 14*d* of said one or more pieces of fabric 14 comprises one or more colorants (not shown).
5. The pet head kit 10 of embodiment 4, wherein said one or more colorants comprise one or more dyes, one or more inks, or any combination thereof.
6. The pet head kit 10 of any one of embodiments 1 to 5, wherein said batting material 15 comprises cotton batting, polyester batting, polyester/cotton blend batting, foam material, or any combination thereof.
7. The pet head kit 10 of any one of embodiments 1 to 6, wherein said first bonding material 16*a* comprises thread, an adhesive, or any combination thereof.
8. The pet head kit 10 of any one of embodiments 1 to 7, wherein said first bonding material 16*a* comprises thread.
9. The pet head kit 10 of any one of embodiments 1 to 8, wherein said first bonding material 16*a* comprises cotton thread, polyester thread, polyester/cotton thread, nylon thread, or any combination thereof.
10. The pet head kit 10 of any one of embodiments 1 to 9, wherein said one or more objects 17 comprise one or more beads 17 (i.e., for eyes, nose, etc.), one or more pieces of hair 17, one or more pieces of artificial hair 17, one or more pieces of fabric 17 (e.g., one or more pieces of felt), one or more ribbons 17, or any combination thereof.
11. The pet head kit 10 of any one of embodiments 1 to 10, wherein said one or more objects 17 are attached to said outer surface 18 of said one or more pieces of fabric 14 via a second bonding material 16 (also referred to as 16*b*).
12. The pet head kit 10 of embodiment 11, wherein said second bonding material 16*b* comprises thread, an adhesive, or any combination thereof.
13. The pet head kit 10 of embodiment 11 or 12, wherein said second bonding material 16*b* comprises an adhesive.
14. The pet head kit 10 of any one of embodiments 11 to 13, wherein said second bonding material 16*b* comprises thread.
15. The pet head kit 10 of any one of embodiments 11 to 14, wherein said second bonding material 16*b* comprises cotton thread, polyester thread, polyester/cotton thread, nylon thread, or any combination thereof.
16. The pet head kit 10 of any one of embodiments 1 to 15, wherein (1) said head male or female connector 19 comprises a metal snap connector component, a hook-and-loop component, an adhesive component, or a magnetic component, and (2) said substrate female or male connector 24 attached to said upper substrate surface 22 comprises a mating/corresponding connector 24 (i.e., a connector 24 that specifically connects with said head male or female connector 19). In preferred embodiments, said head male or female connector 19 comprises a female metal snap connector component, and said substrate female or male connector 24 attached to said upper substrate surface 22 comprises a corresponding male metal snap connector component 24.

17. The pet head kit 10 of any one of embodiments 1 to 16, wherein said accessory item 20 comprises a headband 20*a*.
18. The pet head kit 10 of any one of embodiments 1 to 17, wherein said accessory item 20 comprises a hair bow 20*c*.
19. The pet head kit 10 of any one of embodiments 1 to 18, wherein said accessory item 20 comprises a barrette 20*d*.
20. The pet head kit 10 of any one of embodiments 1 to 19, wherein said accessory item 20 comprises an elastic ponytail holder 20*b*.
21. The pet head kit 10 of any one of embodiments 1 to 20, wherein said substrate 21 comprises a polymeric material, a metallic material, a fabric material, an elastic material, or any combination thereof.
22. The pet head kit 10 of any one of embodiments 1 to 21, wherein said one or more individual stuffed animal heads 11 comprise an elephant head, a dog head, a cat head, a mouse head, a monkey head, an alligator head, a whale head, a hippo head, a fox head, a goat head, a wombat head, a bat head, a caterpillar, a butterfly, a peacock head, an ostrich head, a camel head, a bird head, a lion head, a tiger head, a spider, a giraffe head, a zebra head, a cow head, a snake, a horse head, a rabbit head, a panda bear head, a polar bear head, a grizzly bear head, a gorilla head, a lamb head, a pig head, a koala bear head, a leopard head, a panther head, a turtle head, a lion head, a frog head, a dinosaur head, a duck head, a goose head, a hedgehog head, a ferret head, a ladybug, a bumble bee, a lizard head, a chameleon head, a donkey head, a raccoon head, a squirrel head, a chipmunk head, a rhino head, an octopus, a deer head, a swan head, a penguin head, a crab, a lobster head, a seahorse, a lobster head, a starfish, a teddy bear head, a wolf head, an eagle head, an owl head, a chicken head, an otter head, a turtle head, a moose head, a holiday figure head such as Santa, Mrs. Claus, Snowman, a leprechaun, a witch, a ghost, a ghoul, Cupid, a school mascot head such as a football player, cheerleader, or baseball player, basketball player, hockey player or a soccer player, or any combination thereof.
23. The pet head kit 10 of any one of embodiments 1 to 22, wherein said kit 10 comprises two or more of said individual stuffed animal heads 11.
24. The pet head kit 10 of any one of embodiments 1 to 23, wherein said kit 10 further comprises: a material strip 30 having an strip outer surface 31 and multiple strip female or male connectors 24 attached to said strip outer surface 31, said multiple strip female or male connectors 24 enabling attachment of two or more of said individual stuffed animal heads 11 to said material strip 30 via two or more of said head male or female connectors 24.
25. The pet head kit 10 of any one of embodiments 1 to 24, wherein said kit 10 further comprises: a carrying case 40 sized to house (i) said one or more individual stuffed animal heads 11, and (ii) said one or more accessory items 20.

Methods of Making Pet Head Kits:

26. A method of making the pet head kit 10 of any one of embodiments 1 to 25, said method comprising: combining the one or more individual stuffed animal heads 11 with the one or more accessory items 20 to form a combination of kit components 11/20; and packaging the combination of kit components 11/20.
27. The method of embodiment 26, further comprising: forming at least one individual stuffed animal head 11, wherein said step of forming at least one individual stuffed animal head 11 comprises: attaching two or more portions 14*a* of the one or more pieces of fabric 14 to one another so as to enclose the batting material 15 within the one or more pieces of fabric 14; attaching one or more objects 17 to the outer surface 18 of the one or more pieces of fabric 14 within the upper head portion 12; and attaching a head male or female connector 19 to the outer surface 18 of the one or more pieces of fabric 14 within the lower neck portion 13.
28. The method of embodiment 26 or 27, further comprising: forming the one or more accessory items 20, wherein said step of forming the one or more accessory items 20 comprises: attaching the substrate female or male connector 24 to the upper substrate surface 22.
29. A method of making a pet head kit 10, said method comprising: (I) forming at least one individual stuffed animal head 11, wherein each stuffed animal head 11 has an upper head portion 12 and a lower neck portion 13, said step of forming at least one individual stuffed animal head 11 comprising: attaching two or more portions 14*a* of one or more pieces of fabric 14 to one another so as to enclose a batting material 15 within the one or more pieces of fabric 14; attaching one or more objects 17 to an outer surface 18 of the one or more pieces of fabric 14 within the upper head portion 12; and attaching a head male or female connector 19 to the outer surface 18 of the one or more pieces of fabric 14 within the lower neck portion 13; and (II) forming one or more accessory items 20, wherein each accessory item 20 is selected from the group consisting of a headband 20*a*, a hair bow 20*c*, a barrette 20*d*, an elastic ponytail holder 20*b*, and any combination thereof, wherein said step of forming the one or more accessory items 20 comprises: providing a substrate 21 having an upper substrate surface 22 and a lower substrate surface 23 opposite the upper substrate surface 22; and attaching a substrate female or male connector 24 to the upper substrate surface 22 of the substrate 21, the substrate female or male connector 24 enabling attachment of one of the one or more individual stuffed animal heads 11 to the one or more accessory items 20 via the head male or female connector 19.
30. The method of any one of embodiments 27 to 29, wherein said step of forming at least one individual stuffed animal head 11 comprises forming two or more individual stuffed animal heads 11.
31. The method of any one of embodiments 28 to 30, wherein said step of forming the one or more accessory items 20 comprises forming two or more accessory items 20.

Methods of Using Pet Head Kits:

32. A method of using the pet head kit 10 of any one of embodiments 1 to 25, said method comprising: providing the one or more individual stuffed animal heads 11; and providing the one or more accessory items 20.
33. The method of embodiment 32, said method comprising: selecting a first accessory item 20 from the one or more accessory items 20; and attaching a first individual stuffed animal head 11 of the one or more individual stuffed animal heads 11 to the first accessory item 20.
34. The method of embodiment 33, further comprising: detaching the first individual stuffed animal head 11 from the first accessory item 20; and attaching a second individual stuffed animal head 11 of the one or more individual stuffed animal heads 11 to the first accessory item 20.
35. The method of embodiment 33 or 34, further comprising: selecting a second accessory item 20 from the one or more accessory items 20; and attaching the first individual stuffed animal head 11 of the one or more individual stuffed animal heads 11 to the second accessory item 20.

36. The method of any one of embodiments 32 to 35, further comprising: detaching at least one of the one or more individual stuffed animal heads 11 from a material strip 30 having an strip outer surface 31 and multiple strip female or male connectors 24 attached to the strip outer surface 30, the multiple strip female or male connectors 24 enabling attachment of two or more of the individual stuffed animal heads 11 to the material strip 30 via two or more of the head male or female connectors 24.

37. The method of any one of embodiments 32 to 36, further comprising: storing the one or more individual stuffed animal heads 11 and the one or more accessory items 20 within a carrying case 40.

It should be understood that although the above-described pet head kits 10 and methods are described as "comprising" one or more components or steps, the above-described pet head kits 10 (and components therein, e.g., one or more individual stuffed animal heads 11, and/or one or more accessory items 20) and methods may "comprise," "consists of," or "consist essentially of" any of the above-described components, features or steps of the pet head kits 10 and methods. Consequently, where the present invention, or a portion thereof, has been described with an open-ended term such as "comprising," it should be readily understood that (unless otherwise stated) the description of the present invention, or the portion thereof, should also be interpreted to describe the present invention, or a portion thereof, using the terms "consisting essentially of" or "consisting of" or variations thereof as discussed below.

As used herein, the terms "comprises," "comprising," "includes," "including," "has," "having," "contains", "containing," "characterized by" or any other variation thereof, are intended to encompass a non-exclusive inclusion, subject to any limitation explicitly indicated otherwise, of the recited components. For example, a pet head kit 10 and/or method that "comprise(s)" a list of elements (e.g., components, features or steps) is not necessarily limited to only those elements (or components or steps), but may include other elements (or components or steps) not expressly listed or inherent to the pet head kit 10 and/or method.

As used herein, the transitional phrases "consists of" and "consisting of" exclude any element, step, or component not specified. For example, "consists of" or "consisting of" used in a claim would limit the claim to the components, materials or steps specifically recited in the claim except for impurities ordinarily associated therewith (i.e., impurities within a given component). When the phrase "consists of" or "consisting of" appears in a clause of the body of a claim, rather than immediately following the preamble, the phrase "consists of" or "consisting of" limits only the elements (or components or steps) set forth in that clause; other elements (or components) are not excluded from the claim as a whole.

As used herein, the transitional phrases "consists essentially of" and "consisting essentially of" are used to define pet head kits 10 and/or methods that include materials, steps, features, components, or elements, in addition to those literally disclosed, provided that these additional materials, steps, features, components, or elements do not materially affect the basic and novel characteristic(s) of the claimed invention. The term "consisting essentially of" occupies a middle ground between "comprising" and "consisting of".

Further, it should be understood that the herein-described pet head kits 10 and methods may comprise, consist essentially of, or consist of any of the herein-described components (e.g., one or more individual stuffed animal heads 11, and/or one or more accessory items 20) and features, as shown in the figures with or without any feature(s) not shown in the figures. In other words, in some embodiments, the pet head kits 10 and/or methods of the present invention do not have any additional features other than those shown in the figures, and such additional features, not shown in the figures, are specifically excluded from the pet head kits 10 and/or methods. In other embodiments, the pet head kits 10 and/or methods of the present invention do have one or more additional features that are not shown in the figures.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A pet head kit comprising:

one or more individual stuffed animal heads, wherein each stuffed animal head (i) has an upper head portion and a lower neck portion, and (ii) consists of:

one or more pieces of fabric;

a batting material encompassed by said one or more pieces of fabric;

a first bonding material capable of bonding two or more portions of said one or more pieces of fabric to one another so as to enclose said batting material within said one or more pieces of fabric;

one or more objects attached to an outer surface of said one or more pieces of fabric within said upper head portion via a second bonding material; and a head male or female connector attached to said outer surface of said one or more pieces of fabric within said lower neck portion, said head male or female connector consisting of a metal snap connector component; and one or more wearable accessory items selected from the group consisting of a headband, a hair bow, a barrette, an elastic ponytail holder, and any combination thereof, and (ii) comprises:

a wearable accessory substrate having an upper substrate surface and a lower substrate surface opposite said upper substrate surface; and a substrate female or male metal snap connector component attached to said upper substrate surface, said substrate female or male metal snap connector component enabling attachment of one of said one or more individual stuffed animal heads to said one or more wearable accessory items via (i) said head male or female connector and (ii) said substrate female or male metal snap connector component.

2. The pet head kit of claim 1, wherein said one or more pieces of fabric consist of cotton fabric, polyester fabric, polyester/cotton blend fabric, a pile fabric, or any combination thereof; said batting material consists of cotton batting, polyester batting, polyester/cotton blend batting, foam material, or any combination thereof; and said first bonding material consists of thread.

3. The pet head kit of claim 2, wherein said one or more objects consist of one or more beads, one or more pieces of hair, one or more pieces of artificial hair, one or more pieces of fabric, one or more ribbons, or any combination thereof.

4. The pet head kit of claim 3, wherein said second bonding material consists of thread, an adhesive, or any combination thereof.

5. The pet head kit of claim 4, wherein said second bonding material consists of thread.

6. The pet head kit of claim 1, wherein said one or more wearable accessory items consist of a headband, a hair bow, a barrette, or an elastic ponytail holder.

7. The pet head kit of claim 1, wherein said wearable accessory substrate comprises a polymeric material, a metallic material, a fabric material, an elastic material, or any combination thereof.

8. The pet head kit of claim 1, wherein said one or more individual stuffed animal heads are selected from the group consisting of an elephant head, a dog head, a cat head, a mouse head, a monkey head, an alligator head, a whale head, a hippo head, a fox head, a goat head, a wombat head, a bat head, a caterpillar, a butterfly, a peacock head, an ostrich head, a camel head, a bird head, a lion head, a tiger head, a spider, a giraffe head, a zebra head, a cow head, a snake, a horse head, a rabbit head, a panda bear head, a polar bear head, a grizzly bear head, a gorilla head, a lamb head, a pig head, a koala bear head, a leopard head, a panther head, a turtle head, a lion head, a frog head, a dinosaur head, a duck head, a goose head, a hedgehog head, a ferret head, a ladybug, a bumble bee, a lizard head, a chameleon head, a donkey head, a raccoon head, a squirrel head, a chipmunk head, a rhino head, an octopus, a deer head, a swan head, a penguin head, a crab, a lobster head, a seahorse, a lobster head, a starfish, a teddy bear head, a wolf head, an eagle head, an owl head, a chicken head, an otter head, a turtle head, and a moose head; a holiday figure head selected from the group consisting of Santa, Mrs. Claus, Snowman, a leprechaun, a witch, a ghost, a ghoul, and Cupid; a school mascot head selected from the group consisting of a football player, cheerleader, baseball player, basketball player, hockey player and a soccer player; and any combination thereof.

9. The pet head kit of claim 1, wherein said kit comprises two or more of said individual stuffed animal heads and at least two of said individual stuffed animal heads consist of different animal heads.

10. The pet head kit of claim 1, wherein said kit further comprises:

a fabric material strip having an strip outer surface and multiple strip female or male metal snap connector components attached to said strip outer surface, said multiple strip female or male metal snap connector components enabling attachment of two or more of said individual stuffed animal heads to said fabric material strip via (i) two or more of said head male or female connectors and (ii) said multiple strip female or male metal snap connector components.

11. The pet head kit of claim 10, wherein said kit further comprises:

a carrying case sized to house (i) said one or more individual stuffed animal heads, (ii) said one or more wearable accessory items, and (iii) said fabric material strip.

12. The pet head kit of claim 1, wherein said kit consists of (i) three or more of said individual stuffed animal heads, at least three of said individual stuffed animal heads consisting of different animal heads; and (ii) said one or more wearable accessory items.

13. The pet head kit of claim 10, wherein said kit consists of (i) three or more of said individual stuffed animal heads, at least three of said individual stuffed animal heads consisting of different animal heads; (ii) said one or more wearable accessory items; and (iii) said fabric material strip.

14. The pet head kit of claim 11, wherein said kit consists of (i) three or more of said individual stuffed animal heads, at least three of said individual stuffed animal heads consisting of different animal heads; (ii) said one or more wearable accessory items; (iii) said fabric material strip; and (iv) said carrying case.

15. A pet head kit consisting of:

(I) three or more individual stuffed animal heads, wherein each stuffed animal head (i) has an upper head portion and a lower neck portion, and (ii) consists of:

one or more pieces of fabric;

a batting material encompassed by said one or more pieces of fabric;

a first bonding material capable of bonding two or more portions of said one or more pieces of fabric to one another so as to enclose said batting material within said one or more pieces of fabric;

one or more objects attached to an outer surface of said one or more pieces of fabric within said upper head portion via a second bonding material; and a head male or female metal snap connector component attached to said outer surface of said one or more pieces of fabric within said lower neck portion; and optionally at least one of:

(II) one or more optional wearable accessory items (i) selected from the group consisting of a headband, a hair bow, a barrette, an elastic ponytail holder, and any combination thereof, and (ii) consisting of one or more materials so as to form:

a wearable accessory substrate having an upper substrate surface and a lower substrate surface opposite said upper substrate surface; and a substrate female or male metal snap connector component attached to said upper substrate surface, said substrate female or male metal snap connector component enabling attachment of at least one of said one or more individual stuffed animal heads to said one or more wearable accessory items via (i) said head male or female connector and (ii) said substrate female or male metal snap connector component;

(III) an optional fabric material strip consisting of one or more materials so as to form an strip outer surface and multiple strip female or male metal snap connector components attached to said strip outer surface, said multiple strip female or male metal snap connector components enabling attachment of said three or more individual stuffed animal heads to said optional fabric material strip via (i) three or more of said head male or female connectors and (ii) said multiple strip female or male metal snap connector components; and (IV) an optional carrying case sized to house (i) said three or more individual stuffed animal heads, (ii) said one or more optional wearable accessory items, and (iii) said optional fabric material strip.

16. The pet head kit of claim 15, wherein said kit consists of:

said three or more individual stuffed animal heads; and said one or more optional wearable accessory items.

17. The pet head kit of claim 15, wherein said kit consists of:

said three or more individual stuffed animal heads;

said one or more optional wearable accessory items; and said optional fabric material strip.

18. The pet head kit of claim 15, wherein said kit consists of:

said three or more individual stuffed animal heads;

said one or more optional wearable accessory items; and said optional carrying case.

19. The pet head kit of claim 15, wherein said kit consists of:

said three or more individual stuffed animal heads;

said one or more optional wearable accessory items;

said fabric material strip; and said optional carrying case.

20. A pet head kit comprising:

(I) three or more individual stuffed animal heads, wherein each stuffed animal head (i) has an upper head portion and a lower neck portion, and (ii) consists of:

one or more pieces of fabric;

a batting material encompassed by said one or more pieces of fabric;

a first bonding material capable of bonding two or more portions of said one or more pieces of fabric to one another so as to enclose said batting material within said one or more pieces of fabric;

one or more objects attached to an outer surface of said one or more pieces of fabric within said upper head portion via a second bonding material; and a head male or female metal snap connector component attached to said outer surface of said one or more pieces of fabric within said lower neck portion; and optionally at least one of:

(II) one or more wearable accessory items (i) selected from the group consisting of a headband, a hair bow, a barrette, an elastic ponytail holder, and any combination thereof, and (ii) consisting of one or more materials so as to form:

a wearable accessory substrate having an upper substrate surface and a lower substrate surface opposite said upper substrate surface; and a substrate female or male metal snap connector component attached to said upper substrate surface, said substrate female or male metal snap connector component enabling attachment of at least one of said one or more individual stuffed animal heads to said one or more wearable accessory items via (i) said head male or female connector and (ii) said substrate female or male metal snap connector component;

(III) an fabric material strip consisting of one or more materials so as to form an strip outer surface and multiple strip female or male metal snap connector components attached to said strip outer surface, said multiple strip female or male metal snap connector components enabling attachment of said three or more individual stuffed animal heads to said optional fabric material strip via (i) three or more of said head male or female connectors and (ii) said multiple strip female or male metal snap connector components; and (IV) an carrying case sized to house (i) said three or more individual stuffed animal heads, (ii) said one or more wearable accessory items, and (iii) said fabric material strip.

* * * * *